US008398786B2

(12) United States Patent
Han

(10) Patent No.: US 8,398,786 B2
(45) Date of Patent: Mar. 19, 2013

(54) PRECIPITATION HARDENING COLD ROLLED STEEL SHEET HAVING EXCELLENT YIELD RATIOS, AND THE METHOD FOR MANUFACTURING THE SAME

(75) Inventor: Sang-Ho Han, Kyungsangbook-do (KR)

(73) Assignee: POSCO, Pohang (KR)

( * ) Notice: Subject to any disclaimer, the term of this patent is extended or adjusted under 35 U.S.C. 154(b) by 931 days.

(21) Appl. No.: 12/088,157

(22) PCT Filed: Sep. 28, 2006

(86) PCT No.: PCT/KR2006/003879

§ 371 (c)(1),
(2), (4) Date: May 16, 2008

(87) PCT Pub. No.: WO2007/040317

PCT Pub. Date: Apr. 12, 2007

(65) Prior Publication Data

US 2008/0251166 A1 Oct. 16, 2008

(30) Foreign Application Priority Data

Oct. 6, 2005 (KR) ..... 10-2005-0093976

(51) Int. Cl.
*C22C 38/00* (2006.01)
*C22C 38/60* (2006.01)

(52) U.S. Cl. ..... 148/328; 148/330; 420/87; 420/103; 420/121; 420/127

(58) Field of Classification Search ..... 148/320, 148/328, 330, 405; 420/87, 88, 103, 120, 420/121, 129; *C22C 38/00*
See application file for complete search history.

(56) References Cited

U.S. PATENT DOCUMENTS

| | | | | |
|---|---|---|---|---|
| 2005/0013722 | A1* | 1/2005 | Usami et al. | 420/93 |
| 2006/0108035 | A1* | 5/2006 | Sun | 148/603 |
| 2006/0169365 | A1 | 8/2006 | Ono et al. | |

FOREIGN PATENT DOCUMENTS

| | | | |
|---|---|---|---|
| JP | 56-84422 | | 7/1981 |
| JP | 3-140412 | | 6/1991 |
| JP | 4-221015 | | 8/1992 |
| JP | 07-300623 | | 11/1995 |
| JP | 10-298662 | | 11/1998 |
| JP | 11-229077 | | 8/1999 |
| JP | 11-241119 | | 9/1999 |
| JP | 11-241140 | | 9/1999 |
| JP | 11-269625 | | 10/1999 |
| JP | 2000-345293 | | 12/2000 |
| JP | 2002-327257 | | 11/2002 |
| JP | 2003-342644 | | 12/2003 |
| JP | 2005-146345 | | 6/2005 |
| JP | 2005-187939 | | 7/2005 |
| KR | 10-2006-0072701 | A | 6/2006 |
| WO | WO 02/103073 | * | 12/2002 |
| WO | WO 2005/054534 | | 6/2005 |
| WO | WO 2006/118423 | | 11/2006 |
| WO | WO 2006/118424 | | 11/2006 |
| WO | WO 2006/118425 | | 11/2006 |
| WO | WO 2007/007983 | | 1/2007 |

OTHER PUBLICATIONS

Callister, Jr., William D. "Recovery, Recrystallization, and Grain Growth," Materials Science and Engineering, An Introduction, Sixth Edition, John Wiley & Sons, 2003, pp. 180-184.*

Olefjord et al., "Selective Surface Oxidation During Annealing of Steel Sheets in H2/N2", Applications of Surface Sciences, May 1980, pp. 241-255, vol. 6, No. 3-4,7.

* cited by examiner

*Primary Examiner* — Scott Kastler
*Assistant Examiner* — Vanessa Luk
(74) *Attorney, Agent, or Firm* — McDermott Will & Emery LLP

(57) ABSTRACT

Disclosed herein is a precipitation hardening cold-rolled steel sheet and method for manufacturing the same, which can be used for structural components such as seat rails and the like of a vehicle body. The steel sheet comprises, by weight %, C: 0.07~0.1%, Mn: 1.4~1.7%, P: 0.05~0.07%, S: 0.005% or less, acid-soluble Al: 0.1~0.15%, Nb: 0.06~0.09%, B: 0.0008~0.0012%, Sb: 0.02~0.06%, and the balance of Fe and other unavoidable impurities. The steel sheet has a yield strength of 750 MPa or more and a yield ratio of 85% or more, and is free from surface defects due to a very low degree of oxide enrichment on the surface thereof.

1 Claim, No Drawings

PRECIPITATION HARDENING COLD ROLLED STEEL SHEET HAVING EXCELLENT YIELD RATIOS, AND THE METHOD FOR MANUFACTURING THE SAME

TECHNICAL FIELD

The present invention relates to steel sheets for structural components such as seat rails and the like of a vehicle body. More particularly, the present invention relates to a precipitation hardening cold-rolled steel sheet, which has a yield strength of 750 MPa or more and a yield ratio of 85% or more, and is free from surface defects due to a very low degree of oxide enrichment on the surface thereof, and a method for manufacturing the same.

BACKGROUND ART

With recent intensification of safety regulations for passengers in a vehicle, precipitation hardening type high strength steel sheets have been widely applied to various structural components such as seat rails, pillars, etc. of a vehicle body for an improvement in impact resistance of the vehicle body. Since the precipitation hardening type high strength steel sheet is designed to absorb energy upon collision of the vehicle, it has a characteristic of a high ratio of yield strength versus tensile strength, that is, a high yield ratio (YS/TS).

Typical methods of strengthening steel can be summarized into solid-solution strengthening, grain-refinement strengthening, transformation hardening, and precipitation hardening. Among these methods, it is very difficult for the solid-solution strengthening and grain-refinement strengthening to produce high strength steel having a yield strength of 490 MPa or more with reference to the tensile strength thereof.

Furthermore, since not only does the transformation hardening require a great amount of alloying elements for insurance of strength and formation of transformation microstructure, but also the transformation hardening type steel has substructure of bainite or martensite, it is difficult to assure an excellent yield ratio. Thus, the trans-formation hardening is not appropriate for the components requiring the impact resistance in preparation for collision of the vehicle.

On the other hand, for the precipitation hardening, carbide and nitride formation elements such as Cu, Nb, Ti, V and the like are added to improve the strength via precipitation hardening and grain-refining effects. Thus, the precipitation hardening has a merit in that it can easily achieve high strength of the steel with low manufacturing costs. The precipitation hardening is carried out in such a way of performing solution treatment at high temperatures, followed by cooling the steel to form many fine precipitates, thereby strengthening the steel by virtue of a stress field around the precipitates.

Examples of precipitation hardening type high strength steel are disclosed in Japanese Patent Laid-open Nos. (Sho) 56-84422, (Hei) 4-221015, (Hei) 3-140412, and (Hei) 11-241119.

Techniques disclosed in Japanese Patent Laid-open Nos. (Sho) 56-84422 and (Hei) 4-221015 are to produce a precipitation hardening type high strength steel, which comprises a low content of carbon as a primary component and one or more components selected from Ti, Nb, V and the like as a secondary component, through control of hot rolling and coiling temperatures. The techniques of the disclosures are very effective to improve the strength of the steel by formation of ultra-fine pre-cipitates due to a very low coiling temperature. However, not only do these techniques have difficulty in ensuring the yield strength of 750 MPa or more, but also often suffer from overload during cold rolling due to an increase in residual stress around the precipitates.

Techniques disclosed in Japanese Patent Laid-open Nos. (Hei) 3-140412 and (Hei) 11-241119 are to produce a precipitation hardening type high strength steel by use of Cu precipitates. The techniques of these disclosures are advantageous to ensure the strength of the steel by use of the Cu precipitates, but suffer from alloying defects of a plated steel sheet due to the Cu precipitates and insufficient weldability, which make it difficult to apply the steel in practice.

Ultra strength steel having the yield strength of 750 MPa or more can be produced through particular methods such as addition of great amounts of alloying elements, recovery annealing, transformation control, etc.

One example of such methods is disclosed in Korean Patent Application No. 2004-111413, which produces a high strength steel sheet having the yield strength of 750 MPa or more through recovery annealing by use of steel which comprises, by weight %, C: 0.08~0.12%, Mn: 1.8~2.2%, and suitably controlled amounts of Nb and Mo.

However, the method disclosed in Korean Patent Application No. 2004-111413 has a relatively high content of Mn, and suffers from severe Mn-oxide enrichment on the surface of the steel sheet. As a result, since the steel sheet is likely to be deteriorated in quality due to damage of dies during automotive die machining, this method is not suitable for application to the steel sheet for the vehicle.

DISCLOSURE OF INVENTION

Technical Problem

Therefore, the present invention has been made in view of the above problems, and it is an object of the present to provide a precipitation hardening steel sheet with excellent yield strength and yield ratio, which is free from surface defects resulting from surface enrichment of a Mn-based oxide by suppressing elution of the Mn-based oxide on the surface of the steel sheet through control of Mn content and through an added amount of Sb, and obtains the excellent yield strength and yield ratio by increasing a recovery-recrystallization temperature upon annealing through suitable control of Nb and B, and a method for manufacturing the same.

Technical Solution

In accordance with one aspect of the present invention, the above and other objects can be accomplished by the provision of a precipitation hardening cold-rolled steel sheet with an excellent yield ratio, comprising, by weight %: C: 0.07~0.1%; Mn: 1.4~1.7%; P: 0.05~0.07%; S: 0.005% or less; N: 0.005% or less; acid-soluble Al: 0.1~0.15%; Nb: 0.06~0.09%; B: 0.0008~0.0012%; Sb: 0.02~0.06%, and the balance of Fe and other unavoidable impurities.

In accordance with another aspect of the invention, a method for manufacturing a precipitation hardening cold-rolled steel sheet with an excellent yield ratio is provided, comprising: hot rolling a steel slab with finish rolling at a temperature of $Ar_3$ trans-formation point or more to form a hot-rolled steel sheet, followed by coiling the hot-rolled steel sheet at a temperature of 550~600° C., the steel slab comprising, by weight %: C: 0.07~0.1%, Mn: 1.4~1.7%, P: 0.05~0.07%, S: 0.005% or less, N: 0.005% or less, acid-soluble Al: 0.1~0.15%, Nb: 0.06~0.09%, B: 0.0008~0.0012%, Sb: 0.02~0.06%, and the balance of Fe and other unavoidable impurities cold rolling the hot-rolled steel sheet at a reduction ratio of 50% or more and recovery-recrystallization annealing the cold rolled steel sheet at a line speed of 150~200 mpm and at a temperature of 780~820° C. in a continuous annealing furnace.

ADVANTAGEOUS EFFECTS

As apparent from the above description, the precipitation hardening steel sheet according to the invention is free from surface defects resulting from surface enrichment of a Mn-based oxide by suppressing elution and coarsening of the Mn-based oxide on the surface of the steel sheet through control in added amounts of Mn and Sb, and has a yield strength of 750 MPa or more and a yield ratio of 85% by increasing a recovery-recrystallization temperature upon annealing through suitable control of Nb and B.

BEST MODE FOR CARRYING OUT THE INVENTION

Preferred embodiments of the invention will now be described in detail.

In an effort to find a solution with respect to surface defects resulting from Mn-based oxide enrichment, inventors of the invention have found that elution and coarsening of the Mn-based oxide on the surface of a steel sheet can be suppressed through addition of Sb in combination with reduction in content of Mn. Specifically, the inventors have found that Sb added into the steel serves to obstruct migration of the Mn-based oxide into grain boundaries, thereby noticeably reducing likelihood of surface defects caused by Mn, and to refine crystal grains and increase a recrystallization finishing temperature, thereby somewhat increasing an annealing temperature range to ensure target strength of the steel. With these results, the present invention provides a steel sheet which is free from the surface defects by suppressing the elution of the Mn-based oxide on the surface of the steel sheet by addition of Sb in combination with reduction in content of Mn. Furthermore, according to the present invention, Nb and B are added in combination into the steel to allow NbC precipitates to be formed in large amounts in the crystal grains so that the NbC precipitates react with B, forming acicular ferrite structure. The acicular ferrite structure serves to increase a recovery-recrystallization temperature upon annealing, and enables a recrystallization ratio to be suitably controlled in the range of 65~75% in response to the increased recovery-recrystallization temperature, thereby providing a precipitation hardening cold rolled steel sheet with excellent yield strength and yield ratio, and a method for manufacturing the same. There will be described components of the present invention hereinafter.

C: 0.07~0.1 wt % (hereinafter, %)

C has an important role as a precipitate formation element in steel of the preset invention. If C content is less than 0.07%, a sufficient precipitation effect cannot be obtained, not only making it difficult to ensure the target yield strength, but also providing propensity of coarsening of a NbC carbide. On the other hand, not only does the C content exceeding 0.1% increase likelihood of creating cracks in a cast piece during steel making and continuous casting processes, but also generates bainite structure during hot rolling and coiling, causing a noticeable increase in strength of a hot rolled steel sheet, which leads to an increase in load upon hot rolling and cold rolling. Thus, the carbon content is preferably in the range of 0.07~0.1%.

Mn: 1.4~1.7%

Mn is a solid solution strengthening element, and serves to provide an increase in strength of the steel. In addition, Mn has an important function of suppressing plate fracture and hot embrittlement caused by S during hot rolling. However, as the Mn content increases, a Mn-based oxide is likely to be eluted on the surface of the steel plate during annealing, thereby causing surface defects. According to the present invention, although a lower Mn content is more appropriate for the steel sheet, a predetermined amount or more of Mn is inevitably added to the steel to ensure the strength. If Mn content is less than 1.4%, it is difficult to obtain the target yield strength of 750 MPa or more even with the recovery annealing. On the other hand, if the Mn content exceeds 1.7%, it is advantageous in terms of strength, but the Mn-based inclusions are likely to be eluted on the surface of the steel sheet during the annealing, thereby noticeably deteriorating surface properties of the steel and influencing cleanness and oxidation resistance of the surface. Furthermore, such an excessive Mn content causes an increase of a C equivalent welding index (C+Mn/6).

Thus, the Mn content is preferably in the range of 1.4~1.7%.

P: 0.05~0.07%

P is one of the most advantageous elements to obtain the strength of the steel without significantly deteriorating formability of the steel. However, an excessive added amount of P causes not only a significant increase in possibility of sheet failure during the hot rolling, but also deterioration in the surface properties of the steel. If P content is less than 0.05%, it is difficult to obtain the target strength, whereas if the P content exceeds 0.07%, there is a problem of increasing the likelihood of the brittle fracture. Thus, the P content is preferably in the range of 0.05~0.07%.

S: 0.005% or less, N: 0.005% or less

S and N are inevitably added to the steel as impurities, and thus, it is desirable to control to be the contents of S and N as low as possible. In addition, the contents of S and N are desirably controlled to be as low as possible in order to obtain superior welding properties. However, a reduction in the contents thereof requires an increase in refining costs. Thus, the S content and the N content are preferably 0.005% or less and 0.005% or less, respectively, which are allowable ranges in the art.

Acid-sol. Al: 0.1~10.15%

Acid-sol. Al is an element for the purpose of grain refinement and deoxidation of the steel. If acid-sol. Al content is less than 0.1%, fine AlN precipitates are not formed, causing an insufficient increase of the strength. If the acid-sol. Al content is greater than 0.15%, it is very advantageous in view of high strength of the steel due to the gain refinement effect, but excessive amounts of inclusions are created during steel making and continuous casting processes, thereby increasing not only the likelihood of generating the surface defects, but also the manufacturing costs. Thus, the acid-sol. Al content is preferably in the range of 0.1~10.15%.

Nb: 0.06~0.09%

Nb is also a very important element in view of recovery-recrystallization annealing in combination with B. In this invention, Nb reacts with dissolved C during hot coiling to form great amounts of very fine NbC precipitates in the crystal grains, upon which Nb interacts with B to form the acicular ferrite structure. The acicular ferrite structure acts as a main reason of increasing the recrystallization temperature during the annealing. If Nb content is less than 0.06%, not only does it cause insufficient pre-cipitation of fine precipitates for obtaining the strength, but also requires low temperature annealing. If the Nb content exceeds 0.09%, it is disadvantageous in terms of surface properties and increase in rolling load due to great amounts of fine precipitates. Thus, the Nb content is preferably in the range of 0.06~0.09%.

B: 0.0008~0.0012%

B is an element used for improving weld-toughness through grain refinement. If B content is less than 0.0008%, the steel fails not only to achieve an improvement in weld-toughness due to insufficient grain refinement, but also to prevent the brittle fracture caused by addition of P. If the B content exceeds 0.0012%, there arise problems of an increase in manufacturing costs and a decrease in elongation. Thus, the B content is preferably in the range of 0.0008~0.0012%.

Sb: 0.02~0.06%

Sb is an element to suppress the Mn-based oxide from being eluted on the surface of the steel sheet. With an appropriate added amount of Sb, it is possible not only to obtain the grain refinement, but also to prevent the Mn-based oxide from migrating into the grain boundaries, thereby noticeably improving the effect of preventing the surface defects caused by Mn. Furthermore, since Sb is able to increase a recrystallization finishing temperature even in a small added amount, it can be used to somewhat increase the annealing temperature range for the purpose of obtaining a suitable level of strength. Since a low annealing temperature is inappropriate in view of association with other operations, it is important to set a suitable annealing temperature in view of operability. If Sb content is less than 0.02%, the steel fails to obtain the above effects, whereas if the Sb content exceeds 0.06%, there are problems of a reduction in elongation and an increase in manufacturing costs. Thus, the Sb content is preferably in the range of 0.02~0.06%.

In addition to the above components, the steel of the present invention comprises the balance of Fe and other unavoidable impurities, in which portion of P can be replaced with other solid solution strengthening elements.

A method for manufacturing steel of the invention will now be described in detail.

After preparing a steel slab having the composition as described above, the steel slab is subjected to hot-rolling with finish rolling at a temperature of $Ar_3$ trans-formation point or more, which is a typical hot rolling condition, to provide a hot rolled steel sheet, followed by coiling the hot rolled steel sheet at a temperature of 550~600° C. A coiling temperature less than 550° C. is advantageous to form fine NbC pre-cipitates in the steel and increases the recrystallization temperature, thereby ensuring high strength of the steel. However, such a low coiling temperature is likely to cause a rapid reduction in elongation and a frequent distortion of the sheet which can lead to trouble regarding equipment. On the other hand, if the coiling is performed at a temperature exceeding 600° C., the hot coil suffers from buckling deformation. Thus, the coiling is preferably performed at the temperature in the range of 550~600° C.

After the coiling, the hot-rolled steel sheet is subjected to cold rolling at a reduction ratio of 50% or more. A reduction ratio less than 50% is disadvantageous in view of association with an annealing process, since it results in a small amount of grain nucleation sites in recovery-recrystallization. According to experiments for the present invention, a higher reduction ratio allowed fine precipitates to be formed more easily, increasing the strength of the steel sheet. However, the reduction ratio is preferably 50% or more in consideration of the characteristics of the equipment.

Then, the cold-rolled steel sheet is subjected to recovery-recrystallization annealing at a line speed of 150~200 mpm at a temperature of 780~820° C. in a continuous annealing furnace. A line speed less than 150 mpm provides a very high propensity towards complete recrystallization of the annealed structure even with low temperature annealing so that the steel sheet fails to obtain the target yield strength of 750 MPa or more. On the other hand, a line speed exceeding 200 mpm is more advantageous in view of strength of the steel sheet since it decreases an annealing period and a recrystallization annealing period. However, since such a high line speed puts pressure on the equipment capability, the line speed is preferably in the range of 150~200 mpm. In addition, if the annealing temperature is less than 780° C., the steel sheet is increased in strength, but rapidly reduced in elongation, whereas if the annealing temperature is above 820° C., the steel sheet undergoes complete recrystallization, failing to obtain the target strength. Thus, the annealing temperature is preferably in the range of 780~820° C.

According to the present invention, a recrystallization ratio (where the structure is completely recrystallized upon the annealing) is controlled in the range of 65~75%. If the annealing temperature is too high or if the line speed is significantly low, the recrystallization ratio increases above 75%, thereby making it difficult to obtain the target strength of 750 MPa or more. On the other hand, if the annealing temperature is too low or if the line speed is too high, the yield strength is increased, but the elongation is rapidly decreased. Thus, the recrystallization ratio is preferably in the range of 65~75%.

MODE FOR THE INVENTION

The invention will be described in detail with reference to examples.

EXAMPLES

Test samples were prepared under the condition shown in Table 2 by use of inventive steels A and B and comparative steels A and B having the compositions as shown in Table 1. Then, evaluation was performed with respect to properties of the samples, results of which are shown in Table 2. At this time, a tensile test was performed in a C direction with DIN standard, and a surface enrichment degree was obtained through relative evaluation by observation with naked eyes.

TABLE 1

| | Composition(wt %) | | | | | | | | | |
|---|---|---|---|---|---|---|---|---|---|---|
| Steel Kind | C | Mn | P | S | N | Sb | Nb | Mo | B | Sol. Al |
| IS A | 0.08 | 1.5 | 0.06 | 0.0045 | 0.0028 | 0.04 | 0.07 | — | 0.0009 | 0.11 |
| IS B | 0.09 | 1.6 | 0.055 | 0.0044 | 0.0027 | 0.05 | 0.085 | — | 0.0009 | 0.10 |
| CS A | 0.09 | 1.9 | 0.01 | 0.0048 | 0.004 | — | 0.08 | 0.12 | 0.001 | 0.11 |
| CS B | 0.12 | 2.0 | 0.01 | 0.0046 | 0.0028 | — | 0.12 | — | — | 0.04 |

IS: Inventive Steel

CS: Comparative Steel

TABLE 2

| | | Hot rolling (° C.) | | Cold rolling | Recrystallization annealing | | | | | | |
|---|---|---|---|---|---|---|---|---|---|---|---|
| | | Finish | Coiling | Reduction | Line | Annealing | Properties | | | | |
| Sample No. | Steel Kind | rolling (° C.) | Temp. (° C.) | ratio (%) | speed (mpm) | Temp. (° C.) | SE | YS (MPa) | E(%) | YR (%) | RR (%) |
| IE 1 | IS A | 913 | 580 | 55 | 160 | 790 | ○ | 765 | 13 | 88 | 68 |
| CE 1 | | 915 | 630 | 55 | 220 | 760 | Δ | 680 | 15 | 75 | 73 |
| IE 2 | | 910 | 580 | 55 | 160 | 790 | ○ | 782 | 12 | 87 | 70 |
| IE 3 | | 913 | 580 | 53 | 155 | 800 | ○ | 776 | 12 | 92 | 70 |
| CE 2 | | 905 | 630 | 55 | 170 | 830 | Δ | 620 | 18 | 65 | 100 |
| CE 3 | IS B | 913 | 580 | 45 | 163 | 790 | ○ | 805 | 8 | 93 | 52 |
| CE 4 | | 912 | 520 | 55 | 90 | 790 | ○ | 800 | 8 | 91 | 68 |
| IE 4 | | 907 | 580 | 50 | 182 | 790 | ○ | 765 | 12 | 89 | 67 |
| CE 5 | | 895 | 630 | 50 | 180 | 810 | ○ | 689 | 16 | 88 | 73 |
| CE 6 | CS A | 921 | 580 | 53 | 165 | 790 | X | 695 | 17 | 72 | 72 |
| CE 7 | | 918 | 580 | 55 | 180 | 810 | X | 680 | 14 | 75 | 69 |
| CE 8 | | 908 | 640 | 45 | 155 | 840 | X | 565 | 21 | 72 | 98 |
| CE 9 | CS B | 905 | 580 | 55 | 182 | 790 | X | 700 | 16 | 74 | 69 |
| CE 10 | | 907 | 620 | 53 | 223 | 790 | X | 635 | 18 | 76 | 68 |
| CE 11 | | 913 | 590 | 55 | 170 | 790 | X | 735 | 15 | 70 | 65 |

○: Excellent
Δ: Normal
X: Insuficient
IE: Inventive Example
CE: Comparative Example
SE: Surface Enrichment
YS: Yield Strength
E: Elongation
YR: Yield Ratio
RR: Recrystallization Ratio As can be seen from Table 2, not only does Inventive Examples of Nos. 1 to 4 produced using Inventive Steels A and B according to manufacturing conditions of the invention satisfy requirements of yield strength of 750 MPa or more and of yield ratio of 85% or more, but also are free from surface defects due to their very low oxide enrichment degrees on the surface of the annealed sheet.

Meanwhile, Comparative Examples of Nos. 1 to 11 were produced by use of Comparative Steels A and B not satisfying the composition of the invention or produced according to a different manufacturing condition from that of the invention in the case where the comparative steels satisfy the composition of the present invention. The Comparative Examples of Nos. 1~11 not only failed to obtain the yield strength of 750 MPa or more and the yield ratio of 85% or more, but also had the surface defects due to the oxide enrichment on the surfaces of the samples. Furthermore, as can be seen from Table 2, since Comparative Example No. 1 was produced at the coiling temperature and the annealing temperature deviated from the range of the present invention, it failed to obtain the target yield strength and yield ratio. Comparative Example No. 2 underwent rapid reduction in yield strength due to complete recrystallization, and Comparative Example No. 3 underwent reduction in elongation due to non-recrystallization.

The invention claimed is:

1. A precipitation hardening cold-rolled steel sheet, comprising, by weight %: C: 0.07~0.1%; Mn: 1.4~1.7%; P: 0.05~0.07%; S: 0.005% or less; N: 0.005% or less; acid-soluble Al: 0.1~0.15%; Nb: 0.06~0.09%; B: 0.0008~0.0012%; Sb: 0.02~0.06%, and the balance of Fe and other unavoidable impurities;

wherein the cold-rolled steel sheet comprises acicular ferrite and a recrystallized microstructure having a ratio of65~75%.

* * * * *